252-102 AU 136 5%
12/15/81 X2 4,305,836

United States Patent [19]
Noguchi et al.

[11] 4,305,836
[45] Dec. 15, 1981

[54] DETERGENT COMPOSITION

[75] Inventors: Tatsuhiko Noguchi; Kiichi Endo; Ken Nemoto; Ryuichi Kurita, all of Iwaki, Japan

[73] Assignee: Kureha Kagaku Kogyo Kabushiki Kaisha, Tokyo, Japan

[21] Appl. No.: 116,408

[22] Filed: Jan. 29, 1980

[30] Foreign Application Priority Data

Feb. 6, 1979 [JP] Japan ..... 54-12465

[51] Int. Cl.[3] ..... C11D 3/04

[52] U.S. Cl. ..... 252/117; 252/545; 252/102; 252/89.1; 252/526; 423/385; 252/541; 252/121

[58] Field of Search ..... 252/545, 541, 89.1, 252/102, 526, 117, 121; 423/385, 388

[56] References Cited

U.S. PATENT DOCUMENTS 4,088,611 5/1978 Suzaki et al. ..... 252/541
4,148,742 10/1979 Crutchfield et al. ..... 252/102

*Primary Examiner*—Mayer Weinblatt
*Attorney, Agent, or Firm*—Wegner & Bretschneider

[57] ABSTRACT

A detergent composition containing an anionic surface active agent and/or a nonionic surface active agent, characterized by containing as a builder 5 to 50% by weight of a salt of imido-bis-sulfuric acid, 0.05 to 30% by weight of a salt of a saturated or unsaturated fatty acid or a mixture thereof and 0.1 to 15% by weight of a salt of a polycarboxylic acid or a mixture thereof.

3 Claims, No Drawings

DETERGENT COMPOSITION

This invention relates to a novel detergent composition, and particularly relates to a synthetic detergent composition containing a builder comprising a salt of imido-bis-sulfuric acid, a salt of saturated or unsaturated fatty acid(s) of number of carbon atoms of 12 to 18 and a salt of polycarboxylic acid(s).

The builder herein referred is defined as a substance which has itself no detergency or, if any, has no remarkable detergency, however, once after being taken into a detergent composition improves the cleaning ability of the detergent composition and possibly reduces the necessary concentration of the main active ingredient in the detergent composition. ["Goseisenzai no Chishiki (Synthetic Detergent)" by Keizo Ogino published by Saiwai Shobo.]

There are many points to be elucidated on the builder's mode of action, however, at any rate, the specific properties which are required to a builder are a chelating ability, a buffering ability to alkalinity (the property by which the alkalinity of the washing water is not changed in the presence of a small amount of an acidic substance), an ability of reducing the zetapotential of the solid and liquid dirt particles to which the builder is adsorbed as an anion, an ability of reducing the critical concentration of micell formation (C.M.C.) and other properties such as detergency in broader meaning, non-environment-polluting and economical efficiency.

As the hitherto known builders, the builders of inorganic salts such as sodium tripolyphosphate and other various phosphate salts, sodium silicate, sodium sulfate, sodium carbonate, etc., and the organic builders such as builders of organic chelating substances, builders of high polymeric electrolytes and builders of organic active substances are enumerated. However, among the above-mentioned builders there are none which satisfy all the above-mentioned requisites, and accordingly, it cannot be said that a practically sufficient builder has been developed.

Although, particularly, the sodium tripolyphosphate among the above-mentioned builders has been most broadly put to practical use because of its inherent superior ability as a builder, the abundant utilization of the sodium tripolyphosphate is now deemed as the source of the problem of eutrophication of waste water. Accordingly, the development of its substitute or at least of the devise of reducing the usage of the sodium tripolyphosphate has been expected. As a trial of reducing the usage of the sodium tripolyphosphate, the partial replacement of the sodium tripolyphosphate by a salt of imido-bis-sulfuric acid has been proposed (refer to Japanese Patent Application Laying Open No. 16010/78), however, even in this case, the reduced content of the sodium tripolyphosphate is about 10% by weight of the detergent composition, and greater reduction of the content of the sodium tripolyphosphate causes remarkable reduction of detergency of the composition.

On the other hand, in cases of washing clothes, the presence of the following two stages has been elucidated: The stage I is that of removal of the dirts by chelating ions such as $Ca^{2+}$, $Mg^{2+}$, etc. and the stage II is that of prevention of re-deposition of the dirts by the adsorption of anions onto the surface of the solid and liquid dirts and the surface of fibers to make the zeta-potential of the surfaces of the dirts and the fibers equally negative. According to the invention, it is found that those excellent in chelating activity are effective in removing the dirts of Stage I and those which reduce the zeta-potential of the surface of fibers are effective in preventing the re-deposition of Stage II and that the presence of the salt of polycarboxylic acid having a large activity of chelating and of the salt of fatty acid reducing such zeta-potential is effective on washing the dirts.

That is, the present invention concerns a detergent composition having an excellent dirt-removing power and an excellent power of preventing the re-deposition, which comprises an anionic and/or a nonionic surface active agent, hereinafter referred to as a surface active agent, combined with a salt of imido-bis-sulfuric acid having a moderate chelating ability and a large ability to buffer the pH, a salt of a saturated or unsaturated fatty acid or a mixture thereof having an ability of reducing the zeta-potential of the surfaces of the dirts and the fibers and a salt of an amino- or oxypolycarboxylic acid or a mixture thereof having a chelating ability of catching ions such as $Ca^{2+}$ and $Mg^{2+}$. The detergent composition exhibits an extremely excellent detergency without the coexistence of the sodium tripolyphosphate. The detergency of the detergent composition of the present invention is the same as or greater than the detergency of the conventional detergent composition containing as large amounts as 20% by weight of the sodium tripolyphosphate.

The salt of imido-bis-sulfuric acid used in the detergent composition of the present invention is a compound represented by the general formula of $(M^1SO_3)_2NM^2$, wherein $M^1$ represents sodium, potassium, lithium or ammonium and $M^2$ represents hydrogen, sodium, potassium, lithium or ammonium, and among the compounds, trisodium imido-bis-sulfate wherein both $M^1$ and $M^2$ are sodium (hereinafter referred to as TSIS) is preferable.

The salt of the fatty acid of the present invention is a sodium, potassium or ammonium salt of a saturated or unsaturated fatty acid of a number of carbon atoms of 12 to 18. As the saturated fatty acid, lauric acid, myristic acid, palmitic acid, stearic acid are mentioned, and as the unsaturated fatty acid, oleic acid, linolic acid, linolenic acid, ricinoleic acid, etc. are mentioned. Among them, the detergent composition having been combined with sodium or potassium salt of palmitic acid, oleic acid and stearic acid remarkably reduces the zeta-potential of the surfaces of the dirts and the fibers and as a result, its detergency is outstanding. Concerning the ability of reducing the zeta-potential, the presence of the salt of the fatty acid(s) in the detergent composition is found to be effective from, for instance, the fact that the values of the zeta-potential of 0.04% solution of a sodium salt of a palmitic acid, 0.04% solution of TSIS and water are −53.0, −25.0 and +22.5 mV, respectively, when the $Fe_2O_3$ particles of about 1500 Å diameter are suspended in each solution in an amount of 0.02% by weight.

As amino- or oxypolycarboxylic acid, for example, aminopolycarboxylic acid such as ethylenediaminetetraacetic acid (hereinafter referred to as EDTA), nitrilotriacetic acid (hereinafter referred to as NTA), diethylenetriaminepentaacetic acid, iminodiacetic acid, cyclohexanediaminetetraacetic acid, etc. or its alkali metal salts, and an oxycarboxylic acid such as oxalic acid, tartaric acid, etc. or its alkali metal salt can be utilized.

The builder of the present invention is composed of the combination of a salt of imido-bis-sulfuric acid, a salt of fatty acid(s) and a salt of polycarboxylic acid(s), and the ratio of the components in the builder is 5 to 50% by weight of the salt of imido-bis-sulfuric acid and 0.05 to 30% by weight of the salt of fatty acid(s) and less than 15% by weight, preferably of 0.1 to 7% by weight of the salt of amino- or oxypolycarboxylic acid(s), the residue being any one or more conventional builder-components. The total amount of the salt of imido-bis-sulfuric acid plus that of the salt of fatty acid and the salt of polycarboxylic acid is 50 to 1,000 parts by weight based on an amount of the surface active agent of 100 parts by weight. In addition, it is natural to combine sodium silicate, sodium carbonate, carboxymethylcellulose, sodium sulfate, etc. which are contained in the conventional detergent composition, in the range of the amount conventionally used. Still in addition, various substances, for example, sodium percarbonate, sodium perborate, borax, sodium toluenesulfonate and sodium xylenesulfonate may be admixed, if necessary, as an adjuvant as well as a salt of polyphosphoric acid.

As the anionic surface active agent for use in the present invention, for example, sodium alkylsulfate, sodium alkylbenzenesulfonate, sodium alkylpolyethersulfate, sodium long-chain alpha-olefinesulfonate, etc. are used singly or in combination of more than two appropriately. As the non-ionic surface active agent, polyoxyethylenealkylether, polyoxyethylene long-chain fatty acid ester, polyoxyethylene-polyoxypropylene block copolymer, etc. are used singly or in combination of more than two.

The thus prepared detergent composition of the present invention contains as the builder the combination of trisodium imido-bis-sulfate excellent in pH-buffering activity, a salt of saturated or unsaturated fatty acid(s) having carbon atoms of number of 12 to 18 and excellent in reducing ability to zeta-potential and a salt of amino- or oxypolycarboxylic acids excellent in chelating activity, and exhibits the same or superior detergency as or to the conventional detergent composition containing as much as 20% by weight of the sodium tripolyphosphate by the synergistic effect of the above-mentioned builder component, without utilizing any phophorus compound which has been said to be one of the causes of eutrophication of waste water. The detergent composition of the present invention is also excellent in economical efficiency and high in practical value, however, having very small effects on the environment.

The present invention is explained in detail as follows referring to Examples, and the standard detergent, the contaminated cloth, the test of detergency and the calculation of detergent index used in Examples are as follows:

(1) Composition of the Standard Detergent

| Component | Content (% by weight) |
|---|---|
| sodium n-alkylbenzenesulfonate | 17 |
| sodium tripolyphosphate | 20 |
| sodium metasilicate | 10 |
| sodium carbonate | 3 |
| carboxymethylcellulose | 1 |
| $H_2O$ | 10 |
| sodium sulfate | 39 |

(2) Artificially Contaminated Cloth (Cotton)

A cotton cloth was immersed in a contaminating bath containing 8 parts by weight of oil, 0.3 to 0.4 parts by weight of carbon black and 800 parts by weight of tetrachloroethylene for one minute and then dried to be an artificially contaminated cloth. The above-mentioned oil comprised 15 parts by weight of oleic acid, 7.5 parts by weight of palmitic acid, 7.5 parts by weight of myristic acid, 15 parts by weight of triolein, 15 parts by weight of tripalmitin, 10 parts by weight of cholesterol, 5 parts by weight of squalene, 10 parts by weight of liquid paraffin, 10 parts by weight of cetanol and 5 parts by weight of cholesterol palmitate.

(3) Test of Detergency

Four pieces of the thus prepared artificially contaminated clothes (size of 5×10 cm) were put into a wash-bottle of 400 ml in capacity having 10 steel balls (diameter of 6.5 mm) therein, and washed under the following conditions using a launda-o-meter:

| Conditions of laundry | |
|---|---|
| Concentration of the detergent: | 0.20% by weight |
| Ratio of clothes to water: | 1/50 |
| Water temperature: | 30° C. |
| Time of operation: | 10 minutes |
| Water: | tap-water |
| Water-washing with tap-water at 30° C.: | 5 minutes with 200 ml. |

(4) Calculation for the Index of Detergency

At first, the efficiency of detergence (D) is obtained by the following formula on the standard detergent and the candidate detergent:

$$D = \frac{R - R_o}{R' - R_o} \times 100$$

wherein, R′ is the reflectivity of the original cloth; $R_o$ is the reflectivity of the contaminated cloth before washing and R is the reflectivity of the contaminated cloth after washing, the reflectivities being determined through a green filter.

The index of detergency of the candidate detergent is represented by the ratio of the efficiency of detergence of the candidate detergent to that of the standard detergent multiplied by 100.

EXAMPLES 1 to 15

In the following Examples, fifteen kinds of the detergent compositions of the present invention were prepared by combining 17 parts by weight of a surface active agent shown in Table 1, 10 parts by weight of sodium metasilicate, 3 parts by weight of sodium carbonate, 39 parts by weight of sodium sulfate and the following amounts of TSIS, a salt of fatty acid and a salt of polycarboxylic acid, and the washing test was carried out on each detergent composition to find out the index of detergency of each detergent composition, the results being shown in Table 1.

TABLE 1

| Example No. | Surface active agent | TSIS (parts by weight) | Sodium salt of fatty acid (parts by weight) | | Sodium salt of polycarboxylic acid (parts by weight) | | Index of detergency |
|---|---|---|---|---|---|---|---|
| 1 | LAS* | 30 | oleate | 5 | EDTA | 5 | 110 |
| 2 | Emal 20C** | 30 | oleate | 5 | NTA | 5 | 113 |
| 3 | Emulgen 709*** | 30 | oleate | 5 | EDTA | 5 | 114 |
| 4 | LAS | 30 | palmitate | 5 | NTA | 5 | 119 |
| 5 | LAS | 30 | palmitate | 5 | EDTA | 5 | 125 |
| 6 | LAS | 30 | palmitate | 5 | EDTA | 3 | 115 |
| 7 | LAS | 30 | palmitate | 3 | EDTA | 3 | 112 |
| 8 | LAS | 30 | palmitate | 3 | EDTA | 5 | 116 |
| 9 | LAS | 30 | stearate | 5 | EDTA | 5 | 110 |
| 10 | LAS | 30 | stearate | 3 | EDTA | 3 | 105 |
| 11 | LAS | 40 | stearate | 5 | EDTA | 5 | 111 |
| 12 | LAS | 15 | palmitate | 5 | EDTA | 5 | 121 |
| 13 | LAS | 15 | palmitate | 3 | EDTA | 3 | 105 |
| 14 | Emal 20C | 30 | palmitate | 5 | EDTA | 5 | 120 |
| 15 | Emulgen 709 | 30 | palmitate | 5 | EDTA | 5 | 125 |

Notes:
LAS* contains linear alkyl($C_8 \sim C_{18}$)benzene sulfonate.
Emal 20C** contains poly(n = 3)oxyethylene alkyl($C_{12}$, $C_{13}$)ether sulfate.
Emulgen 709*** contains poly(n = 9)oxyethylene alkyl($C_{12} \sim C_{14}$)ether.

What is claimed is:

1. A detergent composition which is substantially free of polyphosphates and contains at least one anionic surface active agent selected from the group consisting of sodium alkyl sulfate, sodium alkylbenzenesulfonate, sodium alkylpolyether sulfate and sodium long-chain alpha-olefinsulfonate, or at least one non-ionic surface active agent selected from the group consisting of polyoxyethylene alkyl ether, polyoxyethylene long-chain fatty acid ester and polyoxyethylenepolyoxypropylene block copolymer, and a builder, wherein:

said builder comprises 5 to 50 parts by weight of a salt of imido-bis-sulfuric acid represented by the general formula of $(M^1SO_3)_2NM^2$, wherein $M^1$ represents sodium, potassium, lithium or ammonium and $M^2$ represents a hydrogen atom, sodium, potassium, lithium or ammonium, 0.05 to 30 parts by weight of at least one salt of a saturated or unsaturated fatty acid selected from the group consisting of the sodium, potassium and ammonium salts thereof, said saturated or unsaturated fatty acid having 12 to 18 carbon atoms, and 0.1 to 15 parts by weight of at least one salt of a polycarboxylic acid selected from the group consisting of sodium ethylenediamminetetraacetate and sodium nitrilotriacetate.

2. The detergent composition according to claim 1, wherein the salt of imido-bis-sulfuric acid is trisodium imido-bis-sulfate.

3. The detergent composition according to claim 1, wherein the total amount of the salt of imido-bis-sulfuric acid plus that of the salt of fatty acid and the salt of polycarboxylic acid is 50 to 1000 parts by weight based on an amount of the surface active agent of 100 parts by weight.

* * * * *